US009520253B2

(12) United States Patent
Gao

(10) Patent No.: US 9,520,253 B2
(45) Date of Patent: Dec. 13, 2016

(54) BUTTON, BUTTON ARRANGEMENT AND ELECTRONIC DEVICE EMPLOYING SAME

(71) Applicants: SHENZHEN FUTAIHONG PRECISION INDUSTRY CO., LTD., Shenzhen (CN); FIH (Hong Kong) Limited, Kowloon (HK)

(72) Inventor: Yan-Ling Gao, Shenzhen (CN)

(73) Assignees: SHENZHEN FUTAIHONG PRECISION INDUSTRY CO., LTD., Shenzhen (CN); FIH (HONG KONG) LIMITED, Kowloon (HK)

( * ) Notice: Subject to any disclaimer, the term of this patent is extended or adjusted under 35 U.S.C. 154(b) by 212 days.

(21) Appl. No.: 14/336,419

(22) Filed: Jul. 21, 2014

(65) Prior Publication Data

US 2015/0027868 A1 Jan. 29, 2015

(30) Foreign Application Priority Data

Jul. 26, 2013 (CN) ..... 2013 2 04499240 U

(51) Int. Cl.
*H01H 3/12* (2006.01)
*H01H 13/06* (2006.01)

(52) U.S. Cl.
CPC ..... *H01H 13/063* (2013.01); *H01H 2221/05* (2013.01); *H01H 2223/002* (2013.01); *H01H 2229/046* (2013.01)

(58) Field of Classification Search
CPC .... H01H 13/14; H01H 3/12; H01H 2223/002; H01H 13/50
USPC ..... 200/341
See application file for complete search history.

(56) References Cited

U.S. PATENT DOCUMENTS

| | | | | |
|---|---|---|---|---|
| 7,230,196 | B2 * | 6/2007 | Toyama | H01H 13/023 200/314 |
| 7,705,255 | B2 * | 4/2010 | Yokote | H01H 13/06 200/302.2 |
| 8,502,097 | B2 * | 8/2013 | Aldana | H01H 13/85 200/293 |
| 8,513,553 | B2 * | 8/2013 | Goto | B60Q 1/2669 200/296 |
| 8,946,575 | B2 * | 2/2015 | Kikuchi | H01H 13/063 200/302.2 |
| 2007/0034493 | A1 * | 2/2007 | Kawasaki | H01H 13/86 200/302.2 |
| 2011/0005908 | A1 * | 1/2011 | Lin | H01H 13/063 200/302.2 |
| 2013/0050919 | A1 * | 2/2013 | Matsui | H04M 1/18 361/679.01 |
| 2013/0098740 | A1 * | 4/2013 | Cotha | H01H 13/06 200/302.2 |
| 2013/0313087 | A1 * | 11/2013 | Le | H01H 13/06 200/302.2 |

(Continued)

*Primary Examiner* — Kyung Lee
(74) *Attorney, Agent, or Firm* — Zhigang Ma

(57) ABSTRACT

A button is mounted to a housing of an electronic device, the button includes a pressing body and a sealed body. The pressing body is mounted to the housing. The sealed body is coupled to the pressing body, the sealed body defines a slot around an external peripheral wall and forms two opposite elastic walls, the two elastic walls resist to the pressing body and the housing, respectively. An electronic device and a button arrangement employing the button are also disclosed.

11 Claims, 5 Drawing Sheets

(56) References Cited

U.S. PATENT DOCUMENTS

2014/0144762 A1* 5/2014 Cheong ..... H01H 13/06
200/302.2

* cited by examiner

BUTTON, BUTTON ARRANGEMENT AND ELECTRONIC DEVICE EMPLOYING SAME

FIELD

The present disclosure relates to a button and an electronic device employing the button.

BACKGROUND

Most of electronic devices include buttons on one sidewall for functional controlling, such as, power switch button, volume controlling button, screen locking button, or camera switch button. However, such buttons usually include complicated structures to mount on a housing of the electronic device. In addition, there is space between button and the housing, which can prevent for waterproofing and dustproofing.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
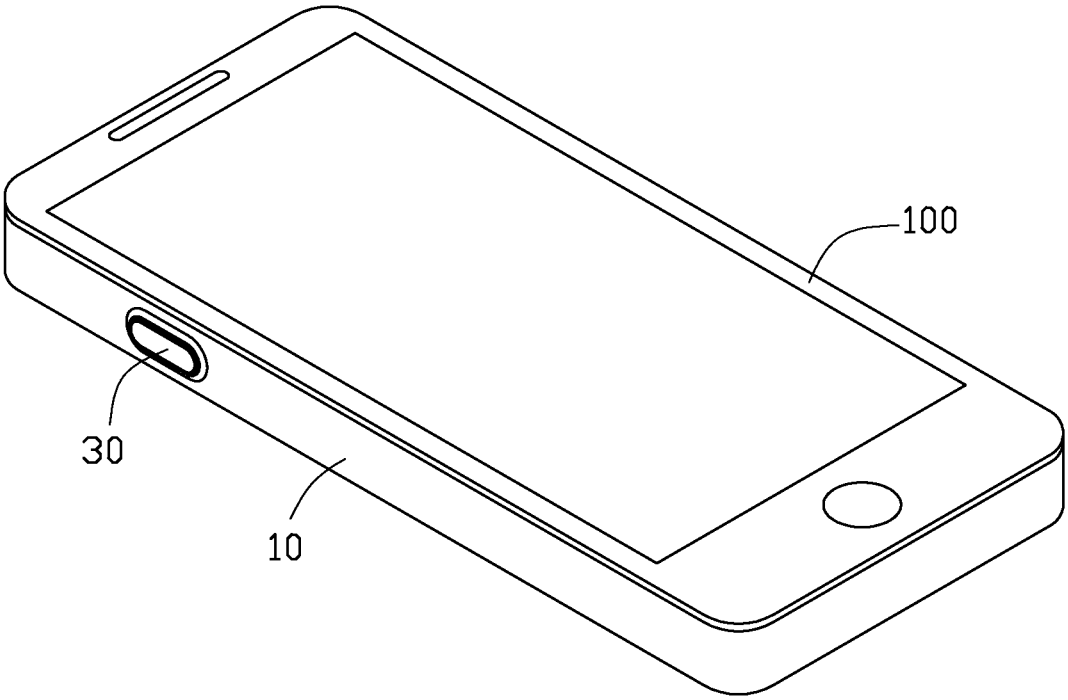
FIG. 1 is an isometric view of an exemplary embodiment of an electronic device including a button.
Figure 2:
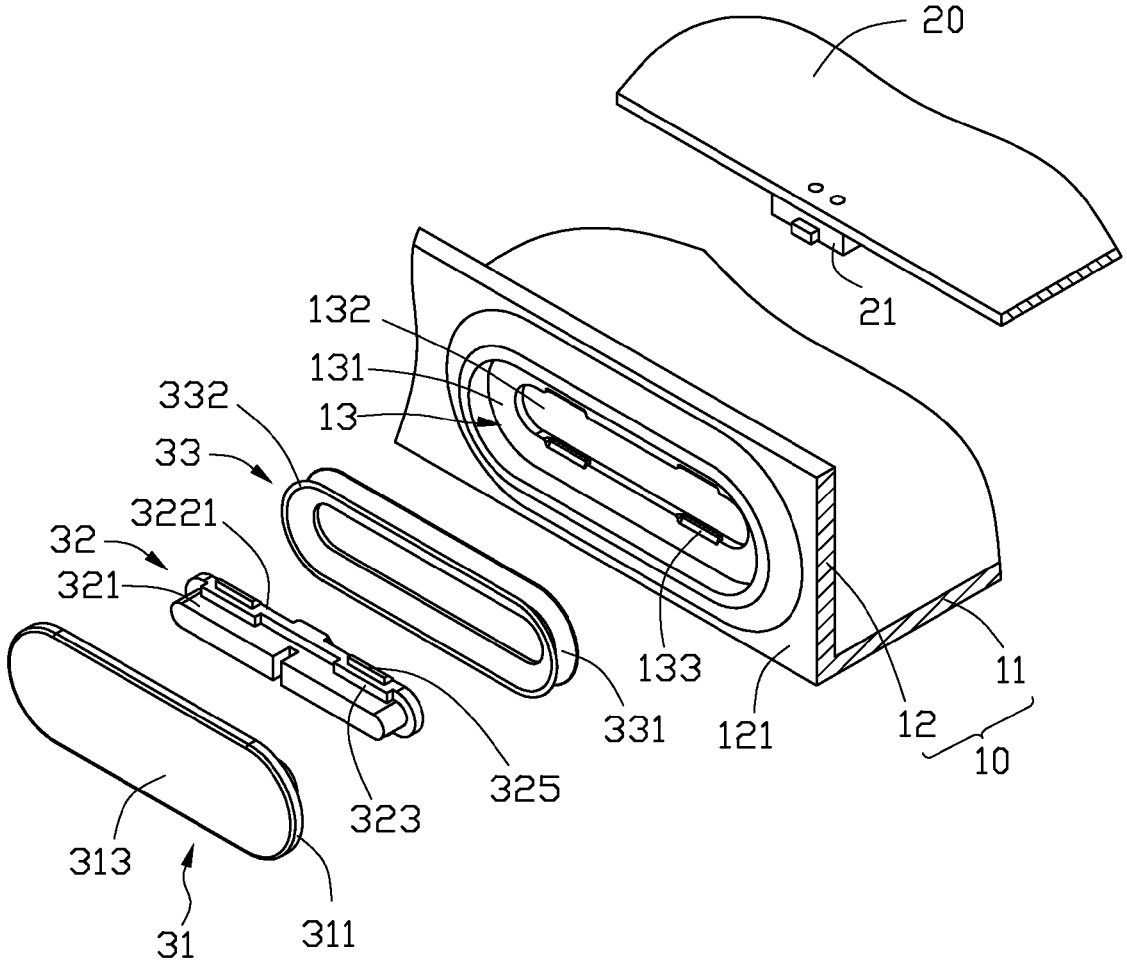
FIG. 2 is a partial exploded view of the electronic device shown in FIG. 1.

FIGS. 1 and 2 illustrate an exemplary embodiment of an electronic device 100 including a housing 10, a circuit board 20 mounted to the housing 10, and a button 30. The electronic device 100 can be mobile phones or tablet computers.

Figure 3:
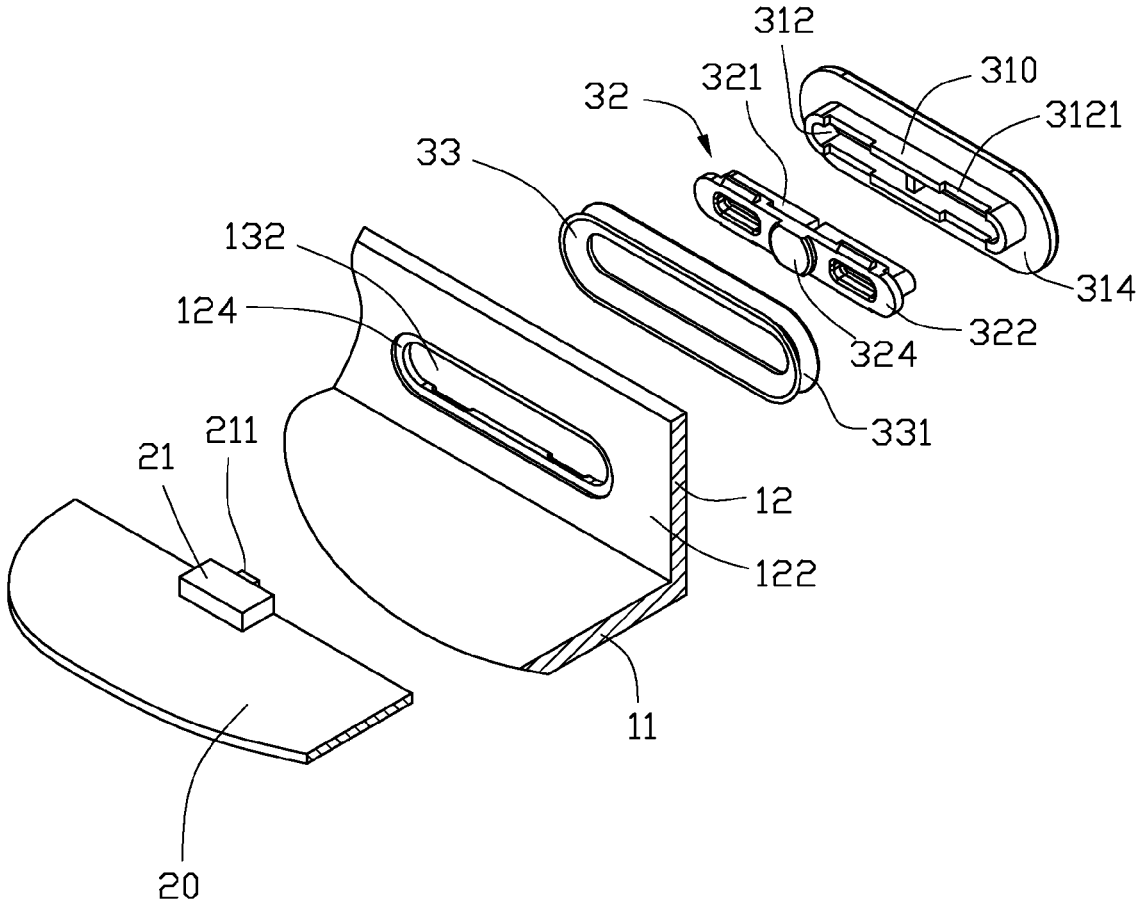
FIG. 3 is another exploded view of the electronic device similar to FIG. 2.

Also referring to FIG. 3, the housing 10 includes a bottom wall 11 and a side wall 12. The side wall 12 includes an outer surface 121, an inner surface 122, and a mounting slot 13. The mounting slot 13 is recessed from the outer surface 121. The mounting slot 13 includes a slot wall 131. The slot wall 131 defines a hole 132. The slot wall 131 further defines a plurality of recesses 133. In at least one embodiment, there are four recesses 133 spaced from each other. The inner surface 122 defines a groove 124.

The circuit board 20 is mounted on the bottom wall 11. The circuit board 20 includes a switch module 21 mounted thereon. The switch module 21 includes a switch button 211. The switch button 211 corresponds to the hole 132.

The button 30 includes a pressing body 31, a main body 32, and a sealed body 33. The pressing body 31 includes a main portion 311 and a protruding portion 310. The main portion 311 is a sheet shaped and includes a pressing surface 313 and a mounting surface 314. The protruding portion 310 is a ring shaped protrusion which protruded from the mounting surface 314. The protruding portion 310 defines a securing slot 312 and a plurality of securing grooves 3121 therethrough.

The main body 32 is substantially rectangular shaped and made of rubber material. The main body 32 can be a portion of the pressing body 31 and be integrally formed by molding. The main body 32 includes two opposite side surfaces 321 and a resisting surface 322 connecting the two side surfaces 321. A peripheral edge of the resisting surface 322 is protruded from the side surfaces 321 and forms a flange 3221. The side surfaces 321 include latching blocks 323 near the flange 3221 and corresponding to the securing grooves 3121. The main body 32 is coupled to the securing slot 312, the latching blocks 323 are coupled to the securing grooves 3121, thus the main body 32 can be secured in the securing slot 312 and protrudes from the mounting surface 314, thereby the main body 32 and the securing slot 312 form a block (not labeled) for securing the sealed body 33. The resisting surface 322 includes a protrusion 324 in a middle portion thereof. The protrusion 324 resists to the switch button 211. The main body 32 further includes a plurality of latches 325, the latches 325 are arranged on the flange 3221 and adjacent to the latching blocks 323. In at least one embodiment, the number of the latches 325 is four.

The sealed body 33 is made of a rubber material and coupled to the pressing body 31. The sealed body 33 is a ring-shaped. A middle of the outer surface of the sealed body 33 is recessed from the outer surface to the inner surface to form an annular slot 331, thus forming a substantially V-shaped viewed from cross-section and from an external peripheral wall, thereby forming two opposite elastic walls 332.

Figure 4:
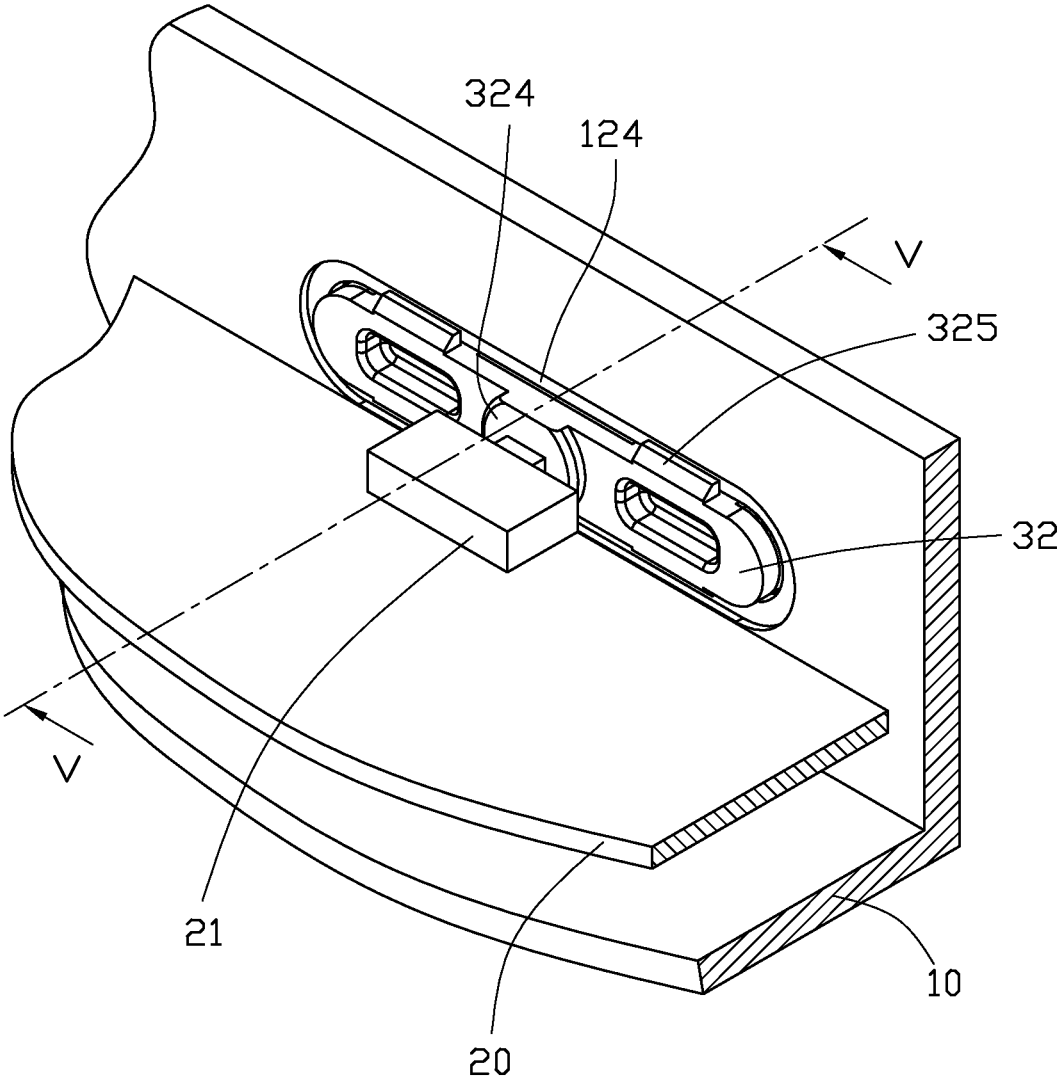
FIG. 4 is a partial assembled view of the electronic device shown in FIG. 2.
Figure 5:
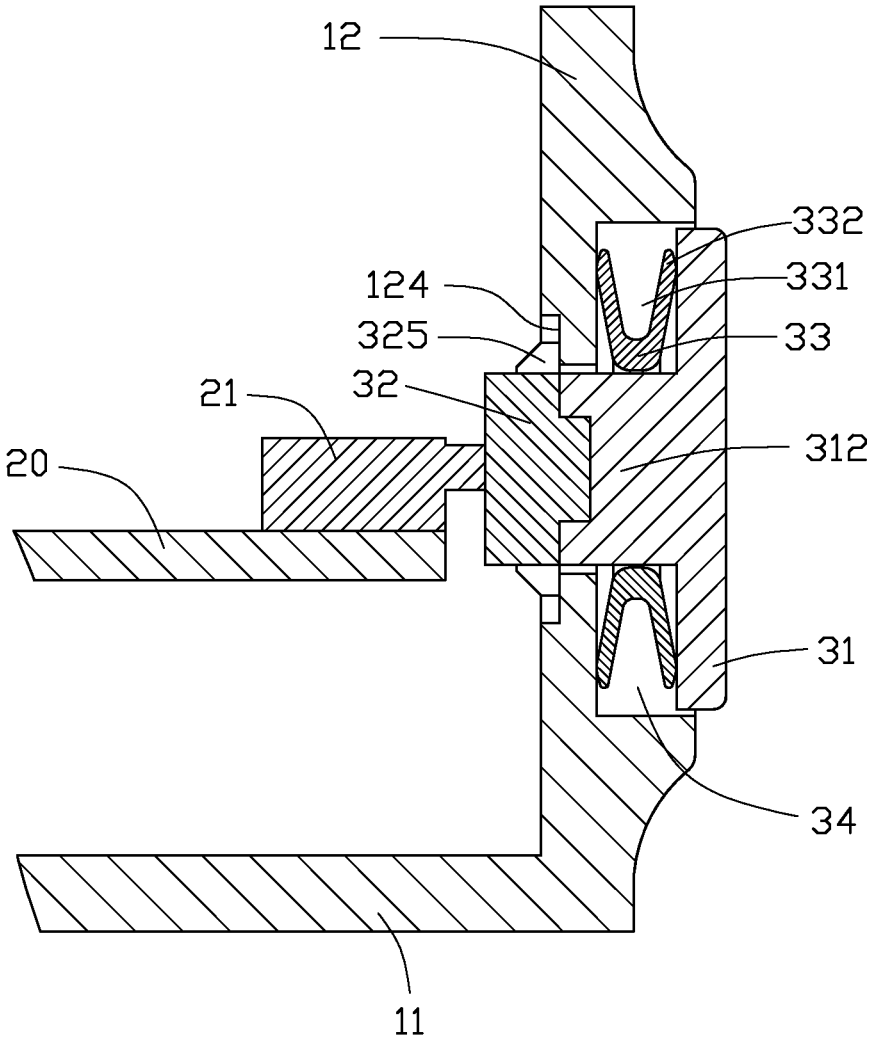
FIG. 5 is a cross-sectional view taken along line V-V of FIG. 4.

Referring to FIGS. 4 and 5, the main body 32 is coupled to the securing slot 312, the latching blocks 323 are latched to the securing grooves 3121, thereby the main body 32 is secured on the pressing body 31. The sealed body 33 is coupled to the block formed by the main body 32 and the securing slot 312, the block is inserted through the hole 132, the latches 325 pass through the recesses 133 and then resist to the groove 124 on the inner surface 122, thus the button 30 is mounted to the housing 10, the protrusion 324 resists to the switch button 211. At this time, the sealed body 33 is located between the mounted surface 314 of the pressing body 31 and the slot wall 131 of the mounting slot 13, the two elastic walls 322 resist to the mounting surface 314 and the slot wall 131, respectively. Therefore, the sealed body 33 can seal the space between the pressing body 31 and the mounting slot 13 and prevent extra pollution, for example water or dust, from entering the housing 10. In addition, when the pressing body 31 is pressed by an external force, the two elastic walls 322 deform and generate elastic force to the pressing body 31, which can improve pressing sense.

It is believed that the embodiments and their advantages will be understood from the foregoing description, and it will be apparent that various changes can be made thereto without departing from the spirit and scope of the disclosure or sacrificing all of its advantages, the examples hereinbefore described merely being embodiments of the disclosure.

What is claimed is:

1. A button mounted to a housing of an electronic device, the button comprising:

a pressing body mounted to the housing;

a sealed body coupled to the pressing body, the sealed body defining a slot along an external peripheral wall and forming two opposite elastic walls, the two elastic walls resisted to the pressing body and the housing, respectively; and a main body;

wherein the pressing body comprises a main portion and a protruding portion protruding from one side of the main portion, the protruding portion defines a securing slot therethrough and a plurality of securing grooves;

wherein the main body comprises two opposite side surfaces and a resisting surface connecting the two opposite side surfaces, a peripheral edge of the resisting surface is protruded from the side surfaces and forms a flange;

wherein the opposite side surfaces comprise latching blocks near the flange and corresponding to the securing grooves, the main body is received in protruding portion defining the securing slot therethrough, thereby the securing slot and the main body form a block, the sealed body is coupled to the block.

2. The button of claim 1, wherein the sealed body is made of rubber and is ring-shaped, and the sealed body defining slot therethrough has a substantially V-shaped cross-section.

3. The button of claim 1, wherein the main body further comprises a plurality of latches arranged on the flange and adjacent to the latching blocks.

4. The button of claim 1, wherein the resisting surface comprises a protrusion in a middle portion.

5. An electronic device, comprising:

a housing defining a mounting slot; and a button mounted to the housing, the button comprising:

a pressing body mounted to the housing;

a sealed body coupled to the pressing body, the sealed body defining a slot along an external peripheral wall and forming two opposite elastic walls; and a main body;

wherein the pressing body is mounted in the housing, defining the mounting slot, the sealed body is resisted between the pressing body and the housing defining the mounted slot, the two elastic walls are resisted to the pressing body and the housing, respectively;

wherein the pressing body comprises a main portion and a protruding portion protruding from one side of the main portion, the protruding portion defines a securing slot therethrough and a plurality of securing grooves;

wherein the main body comprises two opposite side surfaces and a resisting surface connecting the two opposite side surfaces, a peripheral edge of the resisting surface is protruded from the side surfaces and forms a flange;

wherein the opposite side surfaces comprise latching blocks near the flange and corresponding to the securing grooves, the main body is received in protruding portion defining the securing slot therethrough, thereby the securing slot and the main body form a block, the sealed body is coupled to the block.

6. The electronic device of claim 5, wherein sealed body is made of rubber and is ring-shaped, and the sealed body defining slot therethrough has a substantially V-shaped cross-section.

7. The electronic device of claim 5, wherein the main body further comprises a plurality of latches arranged on the flange and adjacent to the latching blocks.

8. The electronic device of claim 5, wherein the resisting surface comprises a protrusion in a middle portion.

9. The electronic device of claim 8, wherein the housing comprises an inner surface and an outer surface, the housing defining the mounting slot is recessed from the outer surface, the housing defining the mounting slot comprises a slot wall, the two elastic walls are resisted to the main portion of the pressing body and the slot wall of the housing.

10. The electronic device of claim 9, wherein the slot wall defines a hole in a middle portion and a plurality of recesses, the inner surface defines a groove opposite to the slot wall, the block of the button is inserted through the hole, the latches pass through the recesses and then resist to the groove.

11. The electronic device of claim 10, further comprising a circuit board, wherein the circuit board comprises a switch module having a switch button, the switch button is corresponding to the hole, the protrusion of the main body resists to the switch button via the hole.

* * * * *